US005674805A

United States Patent [19]

Simpson et al.

[11] Patent Number: 5,674,805

[45] Date of Patent: Oct. 7, 1997

[54] BINDER FOR THERMAL TRANSFER PIGMENT DONOR ELEMENT

[75] Inventors: William H. Simpson, Pittsford; Jacob J. Hastreiter, Jr., Spencerport; Christine J. T. Landry-Coltrain, Fairport; Thomas C. Reiter, Hilton, all of N.Y.

[73] Assignee: Eastman Kodak Company, Rochester, N.Y.

[21] Appl. No.: 758,041

[22] Filed: Nov. 27, 1996

[51] Int. Cl.[6] ..... B41M 5/26

[52] U.S. Cl. ..... 503/227; 156/234; 428/195; 428/329; 428/913; 428/914

[58] Field of Search ..... 156/230, 234, 156/241; 428/195, 329, 411.1, 913, 914; 503/227

[56] References Cited

U.S. PATENT DOCUMENTS

| | | | |
|---|---|---|---|
| 4,684,563 | 8/1987 | Hayashi et al. | 428/207 |
| 5,514,637 | 5/1996 | Lum et al. | 503/227 |

*Primary Examiner*—Bruce H. Hess
*Attorney, Agent, or Firm*—Harold E. Cole

[57] ABSTRACT

This invention relates to a thermal transfer donor element comprising a support having thereon a pigment layer comprising a pigment dispersed in a polymeric binder, said pigment layer being capable of being thermally transferred to a receiver element, wherein said polymeric binder is a phenoxy resin.

18 Claims, No Drawings

BINDER FOR THERMAL TRANSFER PIGMENT DONOR ELEMENT

This invention relates to the use of a certain polymeric binder for a thermal transfer pigment donor element. The donor element is used to produce binary text on a thermal receiver element for optical character recognition (OCR) and bar codes which can be read by scanners.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye diffusion thermal printing can be used to produce bar codes for use in a diversity of areas including packaging, sales, passports and ID cards. Bar codes require only a binary image composed of a very high density, machine-readable black and a low minimum density. The black density in the bar code can be produced by printing dyes sequentially from yellow, magenta and cyan donor elements to the same area of the thermal receiver or by printing from a single dye-donor element which contains the dye mixture necessary to produce black. The same technique can be used to produce alphanumeric characters which can be optically read. In either case it is necessary to incorporate near infrared dyes or optically recognizable alphanumerics into the bar code to accommodate the various scanning devices used. The spectral response range for scanners is considered to be from 600 to 1000 nm which includes the red and near infrared portions of the electromagnetic spectrum.

The near infrared dyes and visible dyes used in dye diffusion thermal printing must be stable to thermal degradation in the dye-donor element, easily transferred to the thermal receiver at low printing energies, and stable to degradation by heat and light after transfer to the receiver.

The dye-donor of a diffusion thermal transfer system usually contains the dyes and a non-transferable polymeric binder which adheres the dyes to the donor substrate. The polymeric binder is chosen such that sticking of donor to receiver during printing at high densities is minimal, preferably non-existent.

As the time for printing (line time) is decreased, additional energy is applied to the dye-donor element to maintain high dye density in the thermal receiver. As the power increases, the propensity of donor/receiver sticking increases because of the higher temperatures attained, not only because of increased energy but also because of lower heat loss to the surroundings.

U.S. Pat. No. 5,514,637 relates to a typical dye diffusion donor wherein a continuous tone image can be printed rendering the appropriate gray scales. In this system, the binder of the dye-donor element usually does not transfer to the receiving element. There is a problem with using this system to print bar codes, however, in that high levels of dye are required to produce a binary image composed of a very high density, machine-readable black.

U.S. patent application Ser. No. 08/757,556, filed of even date herewith by Simpson, Tang and Reiter, and entitled, "Binder For Thermal Transfer Donor Element" relates to a thermal transfer donor element wherein at least one dye is transferred to a receiver along with the binder therefor.

However, a problem has been found with using dyes in a thermal transfer layer wherein the binder also transfers in that such an image is more susceptible to degradation by fingerprint oils or the plasticizers found in poly(vinyl chloride) sleeves since the oils and plasticizers diffuse through the polymeric matrix and react with the dispersed dyes.

It is an object of this invention to provide a thermal transfer donor element wherein higher densities can be obtained than using a dye diffusion transfer element. It is another object of the invention to provide a thermal transfer donor element wherein the transferred image is more resistant to fingerprints and retransfer to poly(vinyl chloride) surfaces. It is still another object of this invention to provide a transferred image which has improved edge sharpness.

These and other objects are achieved in accordance with this invention which relates to a thermal transfer donor element comprising a support having thereon a pigment layer comprising a pigment dispersed in a polymeric binder, said pigment layer being capable of being thermally transferred to a receiver element, wherein said polymeric binder is a phenoxy resin.

Another embodiment of the invention relates to a process of forming a pigment transfer image comprising:

a) imagewise-heating the thermal transfer donor element described above, and b) transferring portions of the pigment layer to a receiving element to form the thermal transfer image.

By using the thermal transfer donor element of the invention, 100% of the pigment is transferred (together with the binder) to the receiver during the printing step. Since less pigment is used in the thermal transfer donor element, it also has better shelf stability to crystallization since the pigment concentration in the polymer is lower.

The binder may be used at any concentration effective for the intended purpose. In general, good results are obtained when the binder is used at a coverage of from about 0.1 to about 5 $g/m^2$. The binder may be present at a concentration of from about 40 to about 80% by weight of the pigment layer.

Any phenoxy resin known to those skilled in the art may be used in the invention. For example, there may be employed the following: Paphen® resins such as Phenoxy Resins PKHC®, PKHH® and PKHJ® from Phenoxy Associates, Rock Hill, S.C.; and 045A and 045B resins from Scientific Polymer Products, Inc. Ontario, N.Y. which have a mean number molecular weight of greater than about 10,000. In a preferred embodiment of the invention, the phenoxy rosin is a Phenoxy Resin PKHC®, PKHH® or PKHJ® having the following formula:

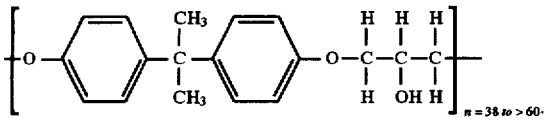

In another embodiment of the invention, various crosslinking agents may be employed with the binder such as titanium alkoxides, polyisocyanates, melamine-formaldehyde, phenol-formaldehyde, urea-formaldehyde, vinyl sulfones and silane coupling agents such as tetraethylorthosilicate. In still another embodiment of the invention, the crosslinking agent is a titanium alkoxide such as titanium tetra-isopropoxide or titanium butoxide. In general, good results have been obtained when the crosslinking agent is present in an anmount of from about 0.01 g/m$^2$ to 0.045 g/m$^2$.

Any pigment can be used in the thermal transfer donor element employed in the invention provided it is transferable to the receiving layer by the action of heat. Especially good results have been obtained with carbon black such as Cabot Black Pearl 700® (Cabot Corp., Mass.) or Raven Black 1200® (Columbia Carbon); copper phthalocyanine (Aldrich Chemical); pigments as disclosed in U.S. Pat. No. 5,516,590 which fluoresce or absorb infrared radiation, etc.

In another embodiment of the invention, aluminum oxide can be added to the pigment layer and has been found to improve edge sharpness.

The receiving element that is used in the invention comprises a support having thereon in image-receiving layer. The support may be a transparent film such as a poly(ether sulfone), a polyimide, a cellulose ester such as cellulose acetate, a poly(vinyl alcohol-co-acetal) or a poly (ethylene terephthalate). The support for the receiving element may also be reflective such as baryta-coated paper, polyethylene-coated paper, white polyester (polyester with white pigment incorporated therein), an ivory paper, a condenser paper, a synthetic paper such as DuPont Tyvek®, or a laminated, microvoided, composite packaging film support as described in U.S. Pat. No. 5,244,861.

The image-receiving layer may comprise, for example, a polycarbonate, a polyurethane, a polyester, poly(vinyl chloride), poly(styrene-co-acrylonitrile), polycaprolactone or mixtures thereof. The image-receiving layer may be present in any amount which is effective for the intended purpose. In general, good results have been obtained at a concentration of from about 1 to about 5 g/m$^2$.

Any material can be used as the support for the thermal transfer donor element of the invention provided it is dimensionally stable and can withstand the heat of the thermal head. Such materials include polyesters such as poly (ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 μm. It may also be coated with a subbing layer, if desired, such as those materials described in U.S. Pat. Nos. 4,695,288 or 4,737,486.

The reverse side of the thermal transfer donor element may be coated with a slipping layer to prevent the printing head from sticking to the thermal transfer donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

A thermal dye transfer assemblage of the invention comprises a) a thermal transfer donor element as described above, and b) a receiving element as described above, the receiving element being in a superposed relationship with the thermal transfer donor element so that the pigment layer of the donor element is in contact with the image-receiving layer of the receiving element.

The above assemblage comprising these two elements may be preassembled as an integral unit when an image is to be obtained. This may be done by temporarily adhering the two elements together at their margins. After transfer, the receiving element is then peeled apart to reveal the dye transfer image.

The following example is provided to illustrate the invention:

EXAMPLE

The following dyes were used in the experimental work:

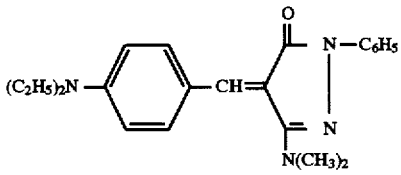

Yellow Dye 1

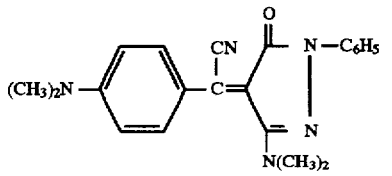

Magenta Dye 2

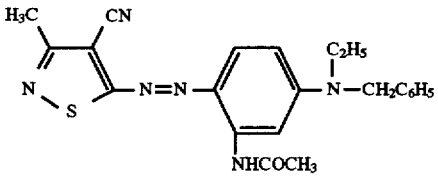

Magenta Dye 3

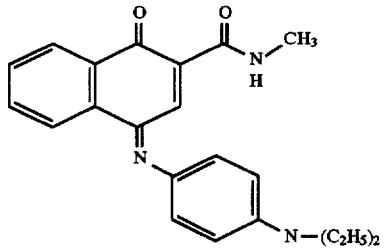

Cyan Dye 4

-continued

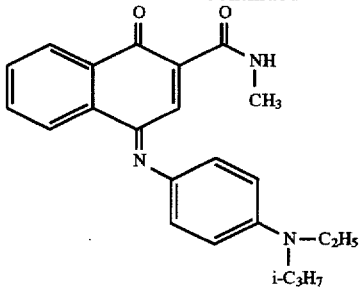

Cyan Dye 5

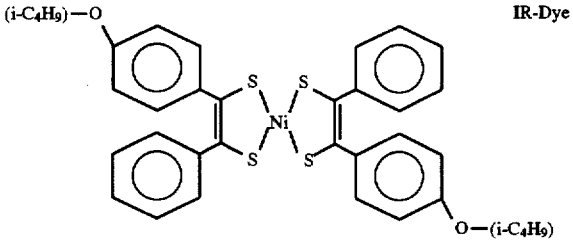

IR-Dye 1

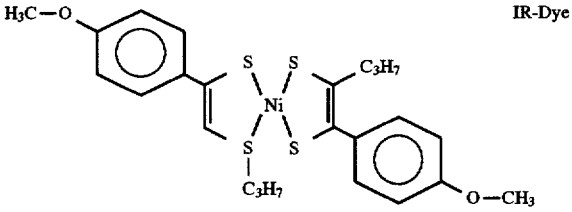

IR-Dye 2

A. Dispersion Preparation

Pigment Dispersions

Two types of dispersions were prepared for evaluation as thermal transfer donors: 1) dispersion Type A which contained 5 wt-% of pigment, 10 wt-% PKHJ® phenoxy resin (Phenoxy Associates, Rock Hill, S.C.), and 3 wt-% Solsperse 24000® (Zeneca Inc., UK); and 2) dispersion Type B which contained 5 wt-% pigment, 10 wt-% PKHJ® phenoxy resin, 2 wt-% Solsperse 24000® and 1 wt-% Solsperse 5000® dispersants (Zeneca Inc., UK).

The mixtures were prepared by dissolving the resin in a solvent composed of 65% toluene, 30% methanol, and 5% cyclopentanone; Solsperse 24000® was added and dissolved; subsequently, Solsperse 5000® was added, if required, and lastly the pigment was stirred in. The resulting mix was milled for 24 hours with 0.4 to 0.6 mm zirconia beads in a Pulverisetto® mill (Fritsch, Germany). After milling, the resulting pigment dispersion was separated from the zirconia beads by diluting 1:1 with solvent and filtering off the zirconia beads. The final dispersion was used in the preparation of the coating melts below.

Aluminum Oxide Dispersion

Solsperse 24000® (10.2 g) was dissolved in 160 g of a toluene/1-propanol/cyclopentanone (65/10/25 wt-%) solvent mixture; 40 g of Oxid-C® aluminum oxide (Degussa AG) was added and the mixture shaken for 20 minutes. To this slurry was added 556 g of zirconium silicate beads 1 mm in diameter. The slurry with the beads was then rolled and shaken on high speed rollers for 24–48 hours. The beads were removed by filtration. The resulting dispersion had an average particle size of 0.02 μm.

B. Donor Elements

A thermal transfer donor element was prepared by coating on a 6.4 μm poly(ethylene terephthalate) substrate (DuPont) which had been coated previously on both sides with Tyzor TBT® Ti tetrabutoxide (DuPont). On one side of the donor substrate was coated a slipping layer composed of poly (vinyl acetal) (Sekisui) (0.383 g/m$^2$), candelilla wax (Strahl & Pitsch) (0.022 g/m$^2$), p-toluenesulfonic acid (0.0003 g/m$^2$), and PS-513, (an aminopropyl dimethyl terminated polydimethyl siloxane), (United Chemical Technologies) (0.010 g/m$^2$). On the opposite side of the so-prepared donor support were coated the dyes shown above in a solution of the PKHJ® phenoxy resin and divinylbenzene beads (Eastman Kodak) dispersed in 60% toluene, 35% n-propanol and 5% cyclopentanone.

Control Dye-Donor

| MATERIAL | COATING WEIGHT (g/m$^2$) |
|---|---|
| Dye 1 | 0.150 |
| Dye 2 | 0.226 |
| Dye 3 | 0.040 |
| Dye 4 | 0.226 |
| Dye 5 | 0.323 |
| IR-Dye 1 | 0.430 |
| IR-Dye 2 | 0.108 |
| 2 μm divinylbenzene beads | 0.027 |
| PKHJ ® phenoxy resin | 0.677 |

Experimental thermal transfer donor elements according to the invention were prepared as shown below.

E-1 A thermal transfer pigment-donor was prepared by diluting a dispersion prepared with carbon black to the appropriate concentration and coating the solution onto 6.4 μm thick PET in exactly the same manner as had been done with the Control Dye Donor. The dry coating weights were:

| MATERIAL | COATING WEIGHT (g/m$^2$) |
|---|---|
| Cabot Black Pearl 700 ® (Cabot Corp., MA) | 0.269 |
| PKHJ ® phenoxy resin | 0.538 |
| Solsperse 24000 ® | 0.161 |

E-2 A second thermal transfer pigment-donor was prepared similar to E-1 except that the carbon black was Raven Black 1200® (Columbia Carbon).

E-3 A third thermal transfer pigment-donor was prepared similar to E-2 except that Solsperse 24000® was used at 0.108 g/m$^2$ and Solsperse 5000® was added at 0.054 g/m$^2$.

E-4 A fourth thermal transfer pigment-donor was prepared similar to E-3 except that the blue pigment, copper phthalocyanine, was used instead of carbon black.

E-5 This element is similar to E-1 except for different amounts and a different phenoxy resin. The PKHH® resin has a lower viscosity than that of PKHJ.

| MATERIAL | COATING WEIGHT (g/m$^2$) |
|---|---|
| Cabot Black Pearl 700 ® | 0.340 |
| PKHH ® phenoxy resin | 1.32 |
| Solsperse 24000 ® | 0.204 |

E-6 This element is similar to E-1 except that the Oxid-C® dispersion (0.161 g/m$^2$) as prepared above was added to the carbon dispersion before coating.

E-7 This element is similar to E-6 except that a microgel (67 mole-% isobutyl methacrylate/30 mole-% 2-ethylhexyl methacrylate/3 mole-% divinylbenzene) (0.011 g/m$^2$) was substituted for the Oxid-C® dispersion.

E-8 This element is similar to E-7 except that the Oxid-C® dispersion (0.161 g/m$^2$) as prepared above was added to the carbon dispersion before coating.

C. Receiver Element

The receiver element consisted of four layers coated on 175 μm Estar® (Eastman Kodak Co.) support.

The first layer, which was coated directly onto the support, consisted of a copolymer of butyl acrylate and acrylic acid (50/50 wt. %) at 8.07 g/m$^2$, 1,4-butanediol diglycidyl ether (Eastman Kodak) at 0.565 g/m$^2$, tributylamine at 0.323 g/m$^2$, Fluorad® FC-431 (3M Corp.) at 0.016 g/m$^2$.

The second layer consisted of a copolymer of 14 mole-% acrylonitrile, 79 mole-% vinylidine chloride and 7 mole-% acrylic acid at 0.538 g/m$^2$, and DC-1248 silicone fluid (Dow Corning) at 0.016 g/m$^2$.

The third layer consisted of Makrolon® KL3-1013 polycarbonate (Bayer AG) at 1.77 g/m$^2$, Lexan 141-112 polycarbonate (General Electric Co.) at 1.45 g/m$^2$, Fluorad® FC-431 at 0.011 g/m$^2$, dibutyl phthalate at 0.323 g/m$^2$, and diphenyl phthalate at 0.323 g/m$^2$.

The fourth, topmost layer of the receiver element, consisted of a copolymer of 50 mole-% bisphenol A, 49 mole-% diethylene glycol and 1 mole-% of a polydimethylsiloxane block at a laydown of 0.646 g/m$^2$, Fluorad® FC-431 at 0.054 g/m$^2$, and DC-510 silicon fluid (Dow Corning) at 0.054 g/m$^2$.

D. Printing Conditions

The dye side of a donor element as described above was placed in contact with the topmost layer of the receiver element. The assemblage was placed between a motor driven platen (35 mm in diameter) and a Kyocera KBE-57-12MGL2 thermal print head which was pressed against the slip layer side of the thermal transfer donor element with a force of 31.2 Newton.

The Kyocera print head has 672 independently addressable heaters with a resolution of 11.81 dots/mm of 1968 Ω average resistance. The imaging electronics were activated and the assemblage was drawn between the printing head and the roller at 26.67 mm/sec. Coincidentally, the resistance elements in the thermal print head were pulsed on for 87.5 microseconds every 91 microseconds. Printing maximum density required 32 pulses "on" time per printed line of 3.175 milliseconds. The maximum voltage supplied was 14.0 volts resulting in an energy of 4.44 J/cm$^2$ to print a maximum Status A density of 2.2 to 2.6. The image was printed with a 1:1 aspect ratio.

E. Testing Procedures

Percent Loss due to Fingerprint Oils

Samples were mounted onto a cardboard sheet with the test surface exposed to the circulated air of an oven. The Status A density of a transferred patch was recorded before testing began. The test fingerprint material, Veriderm® (UpJohn Company), was applied to the sample by touching a pre-selected spot with the finger carrying some of the oily material using moderate pressure. A fingerprint should result which is similar to that left by normal skin oils. Reproducible results could be obtained by washing the finger with hand soap before applying Veriderm®. The samples were then hung in a dark, air-circulated oven thermostatted for 60° C. at 50% RH. The samples were removed after the designated incubation time and the Status A density read at the spot of the artificial fingerprint. The % density loss or increase was recorded as follows:

TABLE I

| | % Status A Density Change | | |
|---|---|---|---|
| Element | Red | Green | Blue |
| Control | −40 | −42 | −39 |
| E-1 | 0 | +2 | +2 |
| E-2 | +2 | +2 | +2 |
| E-3 | +12 | +10 | +12 |
| E-4 | +2 | +1 | +5 |

The above results show that the large loss values for the Control Dye Donor indicate that there is significant degradation of the image area due to the effect of fingerprint oils on the dyes dissolved in the polymer. The small positive values found for the pigment-containing donors of the invention indicate a good stability to fingerprint oils on the thermal transfer image.

Test for Plasticizer Resistance

The printed surface of the sample was placed in contact with a poly(vinyl chloride) (PVC) sleeve which had been cut to the same size as the sample. The sandwich of sample and sleeve was placed onto an aluminum tray and a 1 kg weight was placed on top so that the pressure exerted on the sample was 10.8 g/cm$^2$. The assembly was then placed into an oven which had been thermostatted to 50° C. and 50% RH. The sample was kept in the oven for one week. The transmission density of the dye transferred to the PVC was then recorded as a measure of the plasticizer resistance. A low transmission density implies excellent resistance, whereas a density greater than 0.2 represents poor resistance. The following results were obtained:

TABLE II

| | Status A Transmission Density | | |
|---|---|---|---|
| Element | Red | Green | Blue |
| Control | 1.92 | 2.08 | 2.10 |
| E-1 | 0.02 | 0.02 | 0.02 |
| E-2 | 0.02 | 0.02 | 0.02 |
| E-3 | 0.02 | 0.02 | 0.02 |
| E-4 | 0.02 | 0.02 | 0.02 |
| E-5 | 0.02 | 0.02 | 0.02 |

The above results show that the high transmission density values found for the Control Dye Donor indicate that the plasticizer resistance of the image is very poor. The dyes diffuse readily from that image into the PVC sleeve resulting in a degraded image. The very low values for the pigment-containing thermal transfer donors of the invention indicate an excellent resistance to plasticizers.

Test for Edge Sharpness

Printed alphanumeric characters must have sharp edges for optical scanners to recognize the character and also for ease of visual interpretation of the printed message. Edge sharpness for printed alphanumerics and bar code were evaluated by visual comparison of the samples. An edge which showed a high degree of jaggedness was rated "poor", whereas an edge which showed no visual imperfections was rated "excellent". Normally the edge of a bar in the center of a bar code array was used for the evaluation. The following results were obtained:

TABLE III

| Element | Quality of Tear |
|---|---|
| E-1 | poor |
| E-6 | excellent |
| E-7 | fair |
| E-8 | good |

The above results show that the presence of aluminum oxide in the thermal transfer donor element (E-6 and E-8) significantly improved the edge sharpness over the donor element which had no particles (E-1), whereas incorporation of microgel in the donor melt (E-7) showed some improvement.

The invention has been described in detail with particular reference to preferred embodiments thereof, but it will be understood that variations and modifications can be effected within the spirit and scope of the invention.

What is claimed is:

1. A thermal transfer donor element comprising a support having thereon a pigment layer comprising a pigment dispersed in a polymeric binder, said pigment layer being capable of being thermally transferred to a receiver element, wherein said polymeric binder is a phenoxy resin.

2. The element of claim 1 wherein said binder is present at a concentration of from about 40 to about 80% by weight of said pigment layer.

3. The element of claim 1 wherein said phenoxy resin comprises

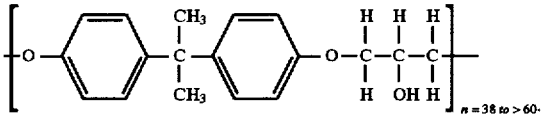

4. The element of claim 1 wherein said pigment comprises carbon black.

5. The element of claim 4 wherein said pigment layer also contains aluminum oxide.

6. The element of claim 1 wherein said pigment comprises copper phthalocyanine.

7. A process of forming a pigment transfer image comprising:

a) imagewise-heating a thermal transfer donor element comprising a support having thereon a pigment layer comprising a pigment dispersed in a polymeric binder, and b) transferring portions of said pigment layer to a receiving element to form said pigment transfer image, wherein said binder is a phenoxy resin.

8. The process of claim 7 wherein said binder is present at a concentration of from about 40 to about 80% by weight of said pigment layer.

9. The process of claim 7 wherein said phenoxy resin comprises

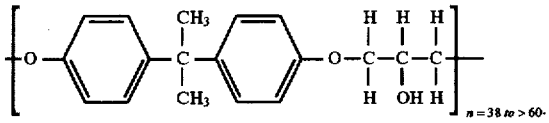

10. The process of claim 7 wherein said pigment comprises carbon black.

11. The process of claim 10 wherein said pigment layer also contains aluminum oxide.

12. The process of claim 7 wherein said pigment comprises copper phthalocyanine.

13. A thermal pigment transfer assemblage comprising:

a) a thermal transfer donor element comprising a support having thereon a pigment layer comprising a pigment dispersed in a polymeric binder, said pigment layer being capable of being thermally transferred to a receiver element, and b) a receiver element comprising a support having thereon an image-receiving layer, said receiver element being in superposed relationship with said thermal transfer donor element so that said pigment layer is in contact with said image-receiving layer, wherein said polymeric binder is a phenoxy resin.

14. The assemblage of claim 13 wherein said binder is present at a concentration of from about 40 to about 80% by weight of said pigment layer.

15. The assemblage of claim 13 wherein said phenoxy resin comprises

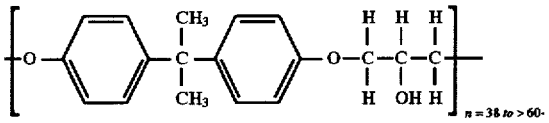

16. The assemblage of claim 13 wherein said pigment comprises carbon black.

17. The assemblage of claim 16 wherein said pigment layer also contains aluminum oxide.

18. The assemblage of claim 13 wherein said pigment comprises copper phthalocyanine.

* * * * *